US007247998B2

(12) United States Patent
Poehlman et al.

(10) Patent No.: US 7,247,998 B2
(45) Date of Patent: Jul. 24, 2007

(54) TRANSIENT DETECTION OF END OF LAMP LIFE CONDITION APPARATUS AND METHOD

(75) Inventors: Tom Poehlman, Madison, AL (US); Bryce Hesterman, Fort Collins, CO (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 10/631,672

(22) Filed: Jul. 31, 2003

(65) Prior Publication Data

US 2004/0257005 A1 Dec. 23, 2004

(51) Int. Cl.
*H05B 37/02* (2006.01)

(52) U.S. Cl. ..... 315/291; 315/209 R

(58) Field of Classification Search ..... 315/307, 315/225, 224, 244, 291, 246, 209, 209 R, 315/247; 363/56.05, 98; 219/121.57
See application file for complete search history.

(56) References Cited

U.S. PATENT DOCUMENTS 3,558,915 A * 1/1971 Wood et al. ..... 327/9
4,044,285 A * 8/1977 Plunkett et al. ..... 318/803
4,429,356 A 1/1984 Inui et al. ..... 363/56
4,583,004 A * 4/1986 Yearsin ..... 307/64
4,939,633 A * 7/1990 Rhodes et al. ..... 363/98
4,952,848 A * 8/1990 Erhardt ..... 315/307
5,023,516 A 6/1991 Ito et al. ..... 315/101
5,055,747 A * 10/1991 Johns ..... 315/307
5,111,114 A 5/1992 Wang ..... 315/225
5,138,235 A 8/1992 Sun et al. ..... 315/209
5,142,202 A 8/1992 Sun et al. ..... 315/225
5,475,284 A 12/1995 Lester et al. ..... 315/209
5,574,335 A 11/1996 Sun ..... 315/119
5,606,224 A 2/1997 Hua ..... 315/121
5,635,799 A 6/1997 Hesterman ..... 315/127
5,686,798 A * 11/1997 Mattas ..... 315/244
5,777,439 A 7/1998 Hua ..... 315/225
5,783,911 A * 7/1998 Rudolph ..... 315/225
5,793,623 A * 8/1998 Kawashima et al. ..... 363/56.05
5,808,422 A 9/1998 Venkitasubrahmanian et al. ..... 315/225
5,834,906 A * 11/1998 Chou et al. ..... 315/307
5,844,197 A * 12/1998 Daniel ..... 219/121.57
5,866,866 A * 2/1999 Shimada ..... 219/110
5,877,592 A 3/1999 Hesterman et al. ..... 315/106
6,072,283 A * 6/2000 Hedrei et al. ..... 315/307

(Continued)

*Primary Examiner*—Don Wong
*Assistant Examiner*—Hung Tran Vy
(74) *Attorney, Agent, or Firm*—Waddey & Patterson; Mark J. Patterson; Larry W. Brantley

(57) ABSTRACT

A sensor system adapted to detect unwanted transients in the primary side of a luminous lamp load driving circuit and effect a change in operation of the driving circuit. A detection circuit is adapted to detect a transient, determine if it is an appropriate end-of-life lamp condition requiring action, and signal an inverter control circuit to provide for an adjustment or shut down of the load driving circuitry. The detection circuit is adapted to detect the transients across the direct current choke as repetitive transients occurring over a period of time. The inverter control circuit includes a negative voltage generator adapted to inhibit power flow into a transistor base inside the inverter. A modified start circuit is also provided with a restart inhibit circuit adapted to prevent the inverter from resuming normal operation after a shutdown condition has been detected.

16 Claims, 2 Drawing Sheets

U.S. PATENT DOCUMENTS 6,127,786 A * 10/2000 Moisin ..... 315/291
6,181,079 B1 * 1/2001 Chang et al. ..... 315/247
6,294,879 B1 * 9/2001 Nagase et al. ..... 315/209 R
6,400,095 B1 * 6/2002 Primisser et al. ..... 315/224
6,759,811 B2 * 7/2004 Okamoto et al. ..... 315/291
2002/0047610 A1 * 4/2002 Arimoto et al. ..... 315/246
2003/0011320 A1 * 1/2003 Okamoto et al. ..... 315/225

* cited by examiner

TRANSIENT DETECTION OF END OF LAMP LIFE CONDITION APPARATUS AND METHOD

BACKGROUND OF THE INVENTION

The present invention is directed to a system for sensing a signal in the primary side of a luminous lamp load driving circuit to detect an end-of-life lamp condition and provide for an adjustment or shut down of the load driving circuitry. More particularly, the present invention is designed to detect the transients across the direct current choke associated with an end of lamp life condition in order to provide a shut down signal for the load driving circuitry.

Ballasts using direct current chokes are known in the art. For example, U.S. Pat. No. 5,877,592 entitled Programmed-start parallel-resonant electronic ballast discloses a ballast having a direct current choke. In addition, patents describing protection circuits capable of detecting end-of-lamp-life conditions in lamps are known in the art. Examples of these circuits are described in U.S. Pat. No. 6,127,786 entitled Ballast having a lamp end of life circuit, U.S. Pat. No. 5,808,422 entitled Lamp ballast with lamp rectification detection circuitry, U.S. Pat. No. 5,777,439 entitled Detection and protection circuit for fluorescent lamps operating at failure mode, U.S. Pat. No. 5,635,799 entitled Lamp Protection Circuit For Electronic Ballasts, U.S. Pat. No. 5,606,224 entitled Protection circuit for fluorescent lamps operating at failure mode, U.S. Pat. No. 5,574,335 entitled Ballast containing protection circuit for detecting rectification of arc discharge lamp, U.S. Pat. No. 5,475,284 entitled Ballast containing circuit for measuring increase in DC voltage component, U.S. Pat. No. 5,142,202 entitled Starting and operating circuit for arc discharge lamp, U.S. Pat. No. 5,138,235 entitled Starting and operating circuit for arc discharge lamp, U.S. Pat. No. 5,111,114 entitled Fluorescent lamp light ballast system, U.S. Pat. No. 5,023,516 entitled Discharge lamp operation apparatus, and U.S. Pat. No. 4,429,356 entitled Transistor Inverter Device. Each of these patents is hereby incorporated by reference.

These patent teach different sensors in an electronic ballast, but fail to teach the use of a sensing circuit coupled to the dc choke for detecting the end of life condition. What is needed, then, is a Transient Detection of End of Lamp Life Condition Apparatus and Method.

SUMMARY OF THE INVENTION

The present invention describes an end-of-life sensor device or apparatus for an electronic ballast having a direct current power supply including a direct current choke. The direct current power supply is coupled to an inverter adapted to power a luminous lamp. The device includes an end-of-life sensor operable to detect changes in the voltage across the direct current choke. Once the appropriate level of voltage changes are detected for an end-of-lamp life condition, the sensor generates an end-of-life signal that is communicated to an inverter control circuit. This inverter control circuit will then change the operation of the inverter when the end-of-life signal is received to reduce the stress on the ballast. In the preferred embodiment, the inverter control circuit will shut down the ballast and stop operation of the inverter.

In one embodiment of the present invention where the ballast is shut down by the inverter control circuit, the start circuit connected to a restart inhibit circuit to inhibit the inverter from restarting and restoring power to the lamp load until the entire unit is de-energized.

A method for controlling a ballast is also taught by the present invention. The method is utilized in a ballast including a direct current choke and an inverter adapted to power a luminous load. The method includes detecting an end-of-life load condition on the direct current choke, and reducing the power provided by the inverter to protect the ballast components.

One advantage and object of the present invention is a prolonged life of the ballast. Yet a further advantage and object is provided in reducing the potential problems associated with an end-of-life failure in a luminous load.

Another advantage of the present invention is the elimination of the need for isolation on the sensing circuit. Sensing circuits connected directly to the lamps in ballasts using transformer isolation must also be isolated in order to ensure that the sensing circuit is properly isolated. The present invention eliminates this requirement by connecting the sensing circuit to the dc choke rather than directly to the lamps. More specifically, the sensing circuit includes an auxiliary winding coupled to the dc choke that allows sensing to be performed on the primary side of the ballast inverter.

Connecting the sensing circuit to the dc choke also eliminates the need for multiple sensing circuits. In ballasts powering multiple lamps in parallel, it is necessary to have sensing circuits coupled to each of the lamps in order to sense lamp failures. This increases the overall costs of these ballasts. By connecting the sensing circuit directly to the dc choke, only one sensing circuit is required, which reduces costs, and that circuit can sense failures in any of the lamps.

The sensing circuit of the present invention also eliminates the need for sensing filament conductivity, which is necessary in some prior art ballasts, and, as a result, can be used for instant-start lamps where there is only one wire from the ballast for each filament.

Other objects and further scope of the applicability of the present invention will become apparent from the detailed description to follow, taken in conjunction with the accompanying drawing wherein like parts are designated by like reference numerals.

DESCRIPTION OF THE PREFERRED EMBODIMENTS

Unlike most ballasts with End-of-Life shutdown circuits that sense an asymmetry or overvoltage at the lamp, this circuit senses a change in the current in the direct current (DC) choke. Load transients, i.e., repetitive fluctuations in the lamp voltage, whether caused by lamp replacement, power on, or an end-of-life lamp, cause a change in the current level into the inverter. During the transition from one current level to another, the voltage on the DC choke primary winding changes. This circuit is designed to sense these voltage changes and shut down the ballast when the voltage changes are caused by fluctuations in an end-of-life lamp. Voltages caused by transients due to lamp replacement and power on will not cause the ballast to shutdown. In other words, the circuit is designed to sense the sustained fluctuations in lamp voltage that occur in end-of-life lamps, yet not shutdown the ballast during temporary transients caused by lamp replacement and power on.

Figure 1:
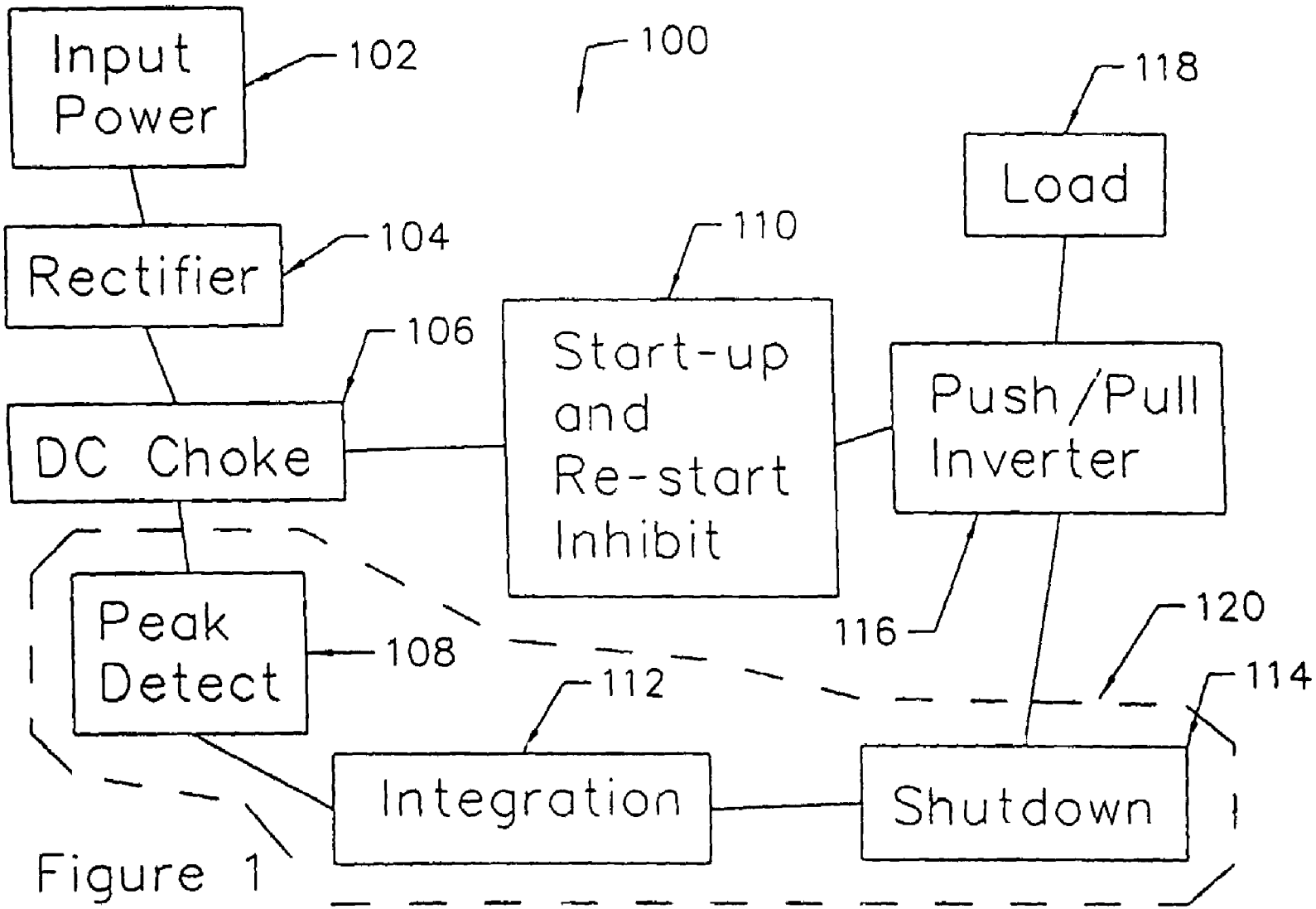
FIG. 1 is a schematic overview of the ballast design of the present invention including the end-of life lamp sensor.

FIG. 1 of the drawings provides a schematic overview of an end-of-life sensing electronic ballast 100 of the present invention including an end-of-life sensor apparatus 120. Input power 102 is provided from a domestic or foreign alternating current (AC) source for providing power to a direct current power supply 105 including rectifying unit 104 coupled to a direct current (DC) choke 106. Power from the DC choke 106 is used by the start-up and re-start inhibit circuit 110 to start and power the inverter 116. The inverter 116 then powers the luminous lamp load 118. The repetitive pulse monitoring circuit 120, also known as the sensor apparatus 120, of the present invention utilizes an end-of-life sensor 108, also known as a peak detection circuit 108, coupled to the DC choke 106 to detect end-of-life conditions in the load 118 and generate and end-of-life signal 109 (see FIG. 2). Signal 109 is only in FIG. 2 for my set of figures. When an end-of-life condition is detected, the peak detection circuit 108 generates an intermediate signal that is coupled to a repetitive pulse monitor 112, also known as the integration circuit 112, to ensure that this is an actual end-of-life condition and filter out inaccurate detections. When an accurate detection is made, the repetitive pulse monitor 112 activates the inverter control circuit 114, also known as the shutdown circuit 114 in the preferred embodiment, to stop or reduce the output of the inverter 116. The skill in the art has several methods for controlling the inverter 116 for a failure or end-of-life condition. Any of these known methods and their associated devices may be used in the present invention, although the present invention preferably operates by shutting down the inverter 116 and then using the start-up and re-start inhibit circuit 110 to prohibit the inverter 116 from starting again until the ballast 100 has been de-energized.

Figure 2:
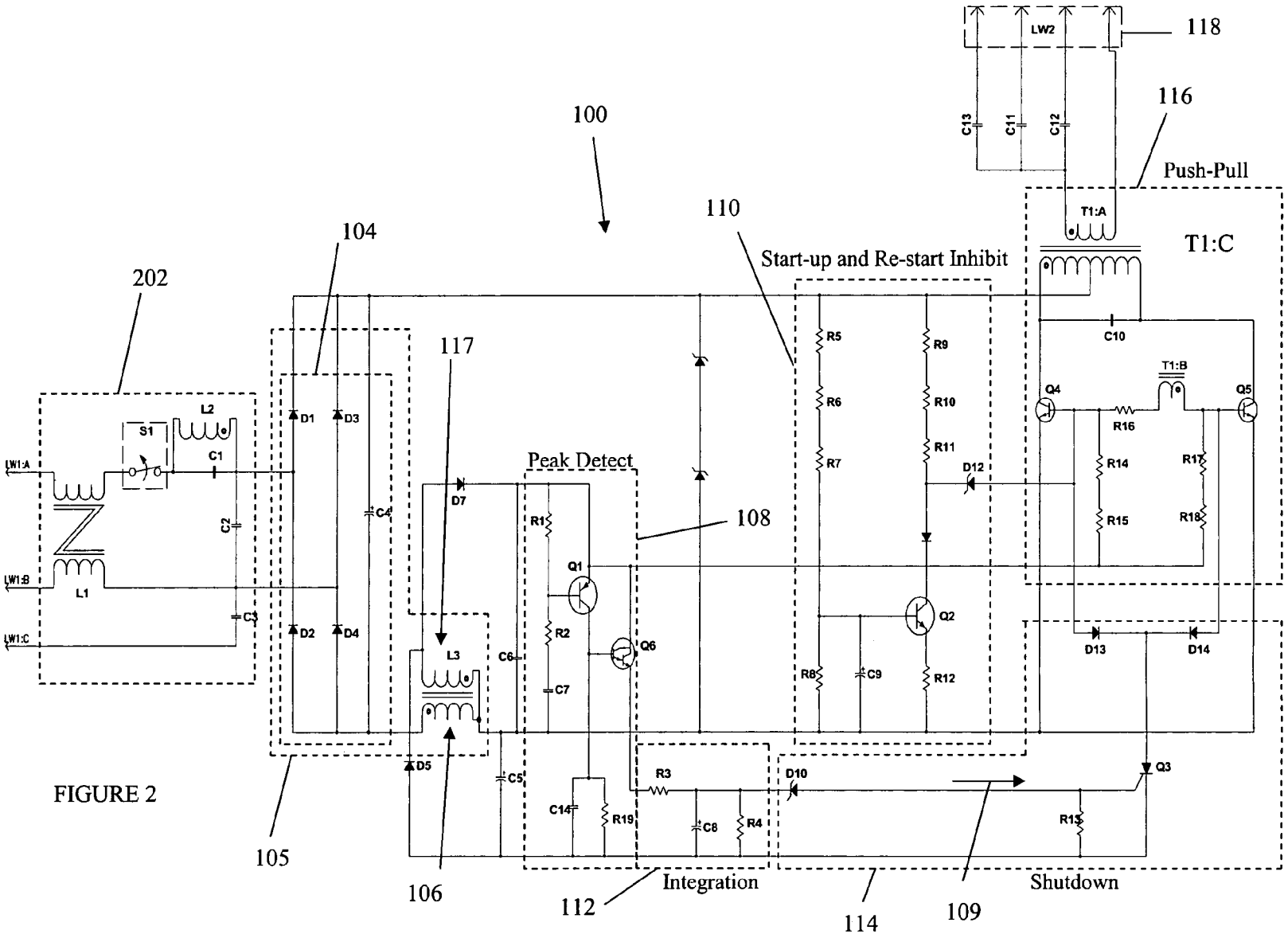
FIG. 2 is an electrical schematic of the preferred circuit embodying the end-of-life sensor in a ballast.

FIG. 2 of the drawings shows the circuitry of the preferred circuit embodying the end-of-life sensor in a ballast. Line voltage from the utility company is provided at LW1:A, LW1:B, and LW1:C. Line voltage is passed through an input filter 202 including an initial inductor L1, switch S1, and inductor-capacitor arrangement L2, C1, C2, C3 to provide an input voltage at the rectifier 104. The rectifier utilizes diodes D1, D2, D3, and D4 to provide a rectified voltage which is smoothed by smoothing capacitor C4. The voltage across smoothing capacitor C4 is provided by a first connection directly to both the start-up and re-start inhibit circuit 110 and the inverter 116, and a second connection through the direct current choke 106 to both the start-up and re-start inhibit circuit 110 and the inverter 116. The direct current choke is shown as choke inductor L3.

The startup and re-start inhibit circuit 110 includes a voltage divider powering time delay capacitor C9 across the base of inhibiting transistor Q2. During the initial charging for time delay capacitor Q9, the incoming power from the rectifier will travel through resistor series R9, R10, R11 as a start circuit to provide power at Zener diode D12. The initial voltage at the cathode of D12 rises to an operating voltage in excess of 18V, causing D12 to conduct in the reverse direction, and allowing approximately 1 mA to flow into the base of power transistor Q4. This biases power transistor Q4 ON and starts the push-pull inverter.

Restarting of the inverter 116 is then prohibited by operation of the restart inhibit circuit including the delay capacitor C9 and the inhibiting transistor Q2. Once capacitor C9 has been charged, inhibiting transistor Q2 will begin to operate as part of the voltage discharge circuit to pull the cathode of Zener diode D12 low to remove the operating voltage and the possibility of conduction by Zener diode D12 which will prohibit a restart of the inverter circuitry 116. (Note that "input line" is not defined.) The voltage divider comprised of R5, R6, R7, and R8 is used to bias inhibiting transistor Q2 on. However, the operation of this voltage divider is affected by a delay circuit including parallel-connected time delay capacitor C9. The voltage divider controls the charge rate on capacitor C9. Capacitor C9 is used to delay inhibiting transistor Q2 from turning on until after the initial start up of the inverter. This provides a delay in the operation of the inhibiting transistor Q2 to allow the initial startup of the inverter 116 and delay the inhibit circuit operation until after the initial start up has been completed. When the shutdown circuit 114 has activated and stopped operation of the inverter, the restart inhibit circuit 110 prevents the inverter 116 from restarting as long as the ballast 100 is energized. As may be understood by this circuit design, bulk electrolytic smoothing capacitor C4 must discharge to allow inhibiting transistor Q2 to shut off.

The voltage across smoothing capacitor C4 is also connected to the inverter 116. A conventional current fed, parallel resonant push pull inverter is made using capacitors C10-13, bipolar power transistors Q4 and Q5, transformer T1, and resistors R14-18. Power from smoothing capacitor C4 is coupled by a connection to transformer T1 at the mid-point of transformer winding T1:C. Power supplied to the mid-point of transformer winding T1:C is then transformed across the core of the transformer T1 to the secondary winding T1:A. The output of the secondary winding T1:A is connected through capacitors C11, C12, and C13 to provide the output at LW2 for powering the luminous lamp load 118.

Returning to the transformer T1, capacitor C10 is connected across the primary side winding T1:C of transformer T1. The end points of the primary winding T1:C of transformer T1 and parallel connected capacitor C10 are connected to the collectors of power transistors Q4 and Q5 respectively. The bases of power transistors Q4 and Q5 are driven by transformer drive winding T1:B. The first end of transformer drive winding T1:B is connected through resistor R16 into the base of power transistor Q4. The second end of transformer drive winding T1:B is directly connected to the base of power transistor Q5. This provides a push-pull configuration inverter as is known in the art. The present invention is designed to be utilized with either push pull or half-bridge types of load driving circuitry. The inverter is also connected to the peak detection circuit 108 and the shutdown circuit 114. The base of power transistor Q4 is connected through resistors R14 and R15 and the base of power transistor Q5 is connected through R16 and R17 to the peak detection circuit 108. The bases of power transistors Q4 and Q5 are also directly connected to the shutdown circuitry 114.

The peak detection circuit 108 is connected to the direct current choke 106, the inverter 116, and the integration circuit 112. Transients are developed across the direct current choke inductor L3 through the connection with the power transistors Q4 and Q5 of the inverter 116. The emitters of power transistors Q4 and Q5 are connected through choke inductor L3 to the output of the rectifier 104 utilizing diodes D1, D2, D3, and D4. This provides a direct coupling of the choke 106 to the inverter 116 such that the transient voltages occurring during operation of the inverter 116 are transferred to the choke 106.

A negative voltage with respect to emitters of Q4 and Q5 is developed through the connection of the diode D5 and capacitor C5 across the auxiliary winding 117 of the choke inductor L3. This negative voltage is utilized in the peak detection circuit 108, the integration circuit 112 and the shutdown circuitry 114.

The peak detection circuit uses a positive rectified value established across the output of the winding of the choke 106 through the utilization of diode D7 which will charge choke capacitor C6 with a choke voltage. Choke capacitor C6 has two functions in the ballast 100. The first is to store energy for the DC bias for the power bipolar transistors Q4 and Q5 in the inverter. The second function is to provide a peak detection voltage that is proportional to the peak voltages across the DC choke.

Once the ballast 100 and lamps 118 have started and stabilized, the voltage on choke capacitor C6 reaches a stable average value with some ripple due to the current provided to the bases of the power bipolar transistors Q4 and Q5. Change monitoring capacitor C7 is arranged to act as a change monitoring component with detection resistors R1 and R2 to detect changes in the voltage on choke capacitor C6. The voltage on change monitoring capacitor C7 lags changes in the voltage across choke capacitor C6 due to resistors R1 and R2. Following a load transient, the voltage on the auxiliary winding 117 of choke inductor L3 rings high, and charges choke capacitor C6 and change monitoring capacitor C7 to a higher voltage. When end-of life transients occur, the charging rate differential between the two capacitors C6 and C7 produces a voltage differential between the base and emitter of detection transistor Q1, also known as peak pulse generator Q1 and peak detection switch Q1. Thus, when the ringing voltage exceeds the steady-state voltage by at least one volt, the voltage across detection resistor R1 is sufficient to turn PNP detection transistor Q1 ON.

Once detection transistor Q1 has been turned on, pulse-stretching capacitor C14 is rapidly charged during the duration of the ringing voltage across choke capacitor C6. After the ringing has subsided, the voltage across capacitor C14 decays through resistor R14. Thus short ringing pulses across choke capacitor C6 result in longer pulses appearing across pulse-stretching capacitor C14. Darlington transistor Q6 functions as a voltage follower with a high input impedance and a low output impedance so that the voltage at the emitter of Q16 tracks the voltage across pulse-stretching capacitor C14 without significantly disturbing that voltage. Each time a pulsed voltage is developed across capacitor C14, integrating capacitor C8 is charged through charge rate control resistor R3. This pulse occurs during each transient on the choke 106 that is of sufficient magnitude. Thus, the peak detection circuit 108 generates pulses when the peak values of the ac voltage waveform across the dc choke 106 rapidly increase beyond the steady-state voltage across the dc choke 106.

The integration circuit 112 accumulates the pulses passing through Darlington transistor Q6, and provides a controlled charge rate and discharge rate to monitor the frequency at which the transients occur. Integrating charge storage capacitor C8, charge rate control resistors R3 and discharge rate control resistor R4 are used to integrate the pulses of current from Darlington transistor Q6 into a voltage that increases with repeated transients. Integrating charge storage capacitor C8 is sized to prevent false triggering of the shutdown circuit 114 when the ballast 100 is originally energized, and during short duration load transients, such as lamp removal and replacement. This is accomplished by making the charge rate higher than the discharge rate for integrating charge storage capacitor C8. The discharge time constant of integrating charge storage capacitor C8 and R4 will be determined by C8 and R4, however, integrating charge storage capacitor C8 will charge much faster through R3. If the voltage developing across integrating charge storage capacitor C8 is from a singular transient and is not associated with the repetitive transients of an end of lamp life condition, then the voltage developed across C8 will be insufficient for the shutdown circuit and this charge will be allowed to discharge through resistor R4 as an unwanted charge. If a repetitive transient occurs, then integrating charge storage capacitor C8 will charge at a faster rate than the discharge rate, and a sufficient voltage will be developed to operate the shutdown circuit 114. The voltage across integrating charge storage capacitor C8 is utilized by the shutdown circuitry to stop the operation of the inverter.

The shutdown circuit 114 is connected to the integration circuit 112, and the inverter 116. During normal operation, a negative voltage of approximately 15 volts with respect to the emitters of power transistors Q4 and Q5 is generated across capacitor C5 by the configuration of choke inductor L3, diode D5 and capacitor C5 to be a reverse polarity voltage from the normal operating voltage on smoothing capacitor C4. When an end-of-life condition is detected, the voltage on integrating charge storage capacitor C8 activates the control switch by reaching the Zener voltage of diode D10, also known as an end-of life signal monitor D10. Zener diode D10 then conducts and allows current to flow from integrating charge storage capacitor C8 to the gate of thyristor Q3, also known as a reverse voltage flow control Q3. Thyristor Q3 is a silicon controlled rectifier (SCR) that is controlled by the bias provided across Zener diode D10 and resistor R13. The base of power transistor Q4 is connected into the shutdown circuitry by diode D13 to be connected to thyristor Q3. The base of power transistor Q5 is similarly connected through diode D14 to be connected to the thyristor Q3. When the Zener diode D10 conducts, this current gates Q3 ON, which presents a negative voltage to the bases of inverter power transistors Q4 and Q5, and stops the oscillations of the inverter. By using this configuration, the shutdown circuit 114 can pull the bases of power transistors Q4 and Q5 low in order to shut down the operation of the inverter 116 and remove power from the lamp load 118. Once the operation of the inverter 116 has been stopped, the inverter 116 will be inhibited from re-igniting by the startup and re-start inhibit circuit 110.

In this manner, an apparatus for detecting end of lamp life conditions on the primary side of the inverter transformer has been established by utilizing transients occurring across a DC choke.

A simplified method of operation of an inverter may be understood with reference to the circuit of FIG. 2, where an end of lamp life condition causes a transient DC current through the DC choke 106. This current is rectified to create a DC voltage on choke capacitor C6. Change monitoring capacitor C7 is connected to C6 to detect this transient such that the transient voltage may turn on Q1. After turning on Q1, the circuit will charge up capacitor 14 through R19 in order to turn on Darlington transistor Q6. Repetitive power flow through Darlington transistor Q6 is utilized through R3 to charge integrating charge storage capacitor C8. The voltage across integrating charge storage capacitor C8 decays between pulses so that several repetitive pulses sufficiently close together are required to generate an increased voltage across capacitor C8. This allows a transient detection charge to build up for repetitive transients. A negative voltage with respect to the emitters of power transistors Q4 and Q5 is also provided across capacitor C5.

Once the transient detection charge has been built up on integrating charge storage capacitor C8, this will overcome the reverse voltage associated with Zener diode D 10 to turn on SCR Q3 to pull both bases of the inverter power transistors Q4 and Q5 negative and shut off the inverter 116. Finally, the inverter 116 will be inhibited from restarting by the start and restart inhibit circuit 110.

Although the present invention has been described using analog circuit elements, the applicant contemplates that the present invention might be implemented digitally as well. For example, the embodiment of the integration circuit 112 shown in FIG. 2 is implemented using a capacitor and a pair of resistors. In alternative embodiments, this circuit may be implemented using a digital pulse counting circuit well known in the art. Furthermore, the present invention may be used with a variety of different push-pull or half-bridge current-fed parallel resonant circuits having dc chokes.

Thus, although there have been described particular embodiments of the present invention of a new and useful Transient Detection of End of Lamp Life Condition Apparatus and Method, it is not intended that such references be construed as limitations upon the scope of this invention except as set forth in the following claims.

What is claimed is:

1. An end-of-life sensor apparatus for an electronic ballast having a direct current power supply including a direct current choke, the direct current power supply coupled to an inverter adapted to power a luminous lamp, the sensor comprising:

an end-of-life sensor directly connected to the direct current choke, and adapted to detect an end-of-life lamp condition and generate an end-of-life signal, the end-of-life sensor including a peak detection circuit and a repetitive pulse monitoring circuit, the peak detection circuit coupled to the direct current choke and adapted to detect changes in the voltage level across the direct current choke and generate peak pulses, the repetitive pulse monitoring circuit adapted to receive the peak pulses, detect an end-of-life lamp condition, and generate the end-of-life signal; and an inverter control circuit electrically adapted to receive the end-of life signal and coupled to the inverter, the inverter control circuit adapted to change the operation of the inverter when the end-of-life signal is received.

2. The apparatus of claim 1, further comprising:

a restart inhibit circuit coupled to the inverter.

3. The apparatus of claim 2, further comprising:

a start circuit coupled to the inverter, wherein the restart inhibit circuit is adapted to selectively inhibit operation of the start circuit.

4. The apparatus of claim 3, the start circuit including a voltage operated switch activated by an operating voltage; and the restart inhibit circuit including a voltage discharge circuit adapted to remove the operating voltage from the voltage operated switch.

5. The apparatus of claim 4, the restart inhibit circuit further comprising:

a delay circuit adapted to delay operation of the restart inhibit circuit during an initial startup of the ballast.

6. The apparatus of claim 1, the peak detection circuit comprising:

a change monitoring component adapted to detect a change from the normal state operating condition of the direct current choke; and a peak pulse generator coupled to the change monitoring component, the peak pulse generator adapted to generate the peak pulses when the change component detects the change from the normal state operating condition.

7. The apparatus of claim 6, further comprising:

a choke capacitor coupled to the direct current choke through a rectifier to establish a peak-detection voltage;

the change monitoring component including a change capacitor connected in parallel with the choke capacitor through a resistance such that a change voltage across the change capacitor lags the peak-detection voltage across the choke capacitor.

8. The apparatus of claim 7, further comprising:

a peak detection switch electrically connected to the change capacitor, the peak detection switch adapted to pulse power flow to form the peak pulses for the repetitive pulse monitoring circuit when the difference between the voltages across the change and choke capacitors exceeds an established voltage threshold.

9. The apparatus of claim 1, the repetitive pulse monitoring circuit comprising:

a charge storage element adapted to accumulate the pulses from the peak detection circuit to generate the end-of-life signal.

10. The apparatus of claim 9, further comprising:

a charge rate control element coupled to the charge storage element establishing a charge rate; and a discharge rate control element coupled to the charge storage element establishing a discharge rate, wherein the charge rate during the peak pulses is faster than the discharge rate.

11. The apparatus of claim 1, the inverter control circuit comprising: a shutdown circuit coupled to the inverter and adapted to stop operation of the inverter.

12. The apparatus of claim 11, the inverter including a forward operating voltage during operation of the inverter, the shutdown circuit comprising:

a reverse voltage generator adapted to generate a reverse polarity voltage; and a control switch adapted to receive the end-of life signal, the control switch adapted to selectively apply the reverse polarity voltage to the inverter to override the forward operating voltage when the end-of-life signal is received.

13. The apparatus of claim 12, the reverse voltage generator comprising:

a diode series connected to a capacitor, the diode and capacitor connected in parallel with a direct current choke winding.

14. The apparatus of claim 12, the control switch comprising:

an end-of-life signal monitor adapted to detect the end-of-life signal; and a reverse voltage flow control coupled to the end-of-life signal monitor, the reverse voltage flow control adapted to block the reverse polarity voltage until the end-of life signal monitor detects the end-of-life signal.

15. The apparatus of claim 14, the end-of-life signal monitor comprising:

a Zener diode.

16. The apparatus of claim 14, the reverse voltage flow control comprising:

a thyristor.

* * * * *